US006308755B1

(12) United States Patent
Chiang

(10) Patent No.: US 6,308,755 B1
(45) Date of Patent: Oct. 30, 2001

(54) WOOD PLANING MACHINE

(76) Inventor: Pei-Lieh Chiang, No. 12, Nan-Ping Rd., Nan Dist., Taichung City (TW)

( * ) Notice: Subject to any disclaimer, the term of this patent is extended or adjusted under 35 U.S.C. 154(b) by 0 days.

(21) Appl. No.: 09/709,702

(22) Filed: Nov. 9, 2000

(51) Int. Cl.[7] ..... B27C 1/00

(52) U.S. Cl. ..... 144/130; 33/642; 33/791; 83/522.19; 144/117.1; 409/210; 409/218; 451/9

(58) Field of Search ..... 33/626, 640, 642, 33/700, 710, 791, 792; 83/522.15, 522.19; 144/114.1, 116, 117.1, 129, 130, 323; 409/210, 214, 218, 220; 451/9, 296

(56) References Cited

U.S. PATENT DOCUMENTS 2,520,868 * 8/1950 Whiting ..... 451/9
2,658,424 * 11/1953 Huck ..... 409/210 X
3,067,788 * 12/1962 Eschenburg ..... 144/117.1
5,771,949 6/1998 Welsh et al. ..... 144/130
6,131,628 * 10/2000 Chiang ..... 144/130

* cited by examiner

*Primary Examiner*—W. Donald Bray
(74) *Attorney, Agent, or Firm*—Christie, Parker & Hale, LLP

(57) ABSTRACT

A wood planing machine includes a base, a cutter carriage, a rotary cutter adapted to shave a workpiece, a height adjusting unit, and a shaving thickness indicator including a seat having a bottom opening, a supporting member mounted on the seat and having an aperture aligned with the bottom opening, an actuating member seated on a periphery of the aperture, a pointer, and a cam member connected to the pointer and mounted rotatably on the seat, and having a bottom lobe abutting against the actuating member. The actuating member is lifted by the workpiece during operation to actuate the cam member to rotate.

8 Claims, 7 Drawing Sheets

WOOD PLANING MACHINE

BACKGROUND OF THE INVENTION

1. Field of the invention

This invention relates to a wood planing machine, more particularly to a wood planing machine having a shaving thickness indicator that indicates the thickness of shaving which is shaved from a workpiece by the wood planing machine.

2. Description of the related art

FIGS. 1 to 3 illustrate a conventional wood planing machine 10 that is disclosed in U.S. Pat. No. 5,771,949. The wood planing machine 10 includes a base 11 with upstanding posts 12 disposed at the corners of the base 11 for supporting a cutter carriage 13 thereon, and a height adjusting unit (not shown) for adjusting height of the cutter carriage 13 via a handle 14 which is mounted on a top end of the wood planing machine 10. The cutter carriage 13 confines with the base 11 a wood passageway therebetween for passage of a workpiece 20. A shaving thickness indicator is mounted on a front lower end of the cutter carriage 13, and includes a resilient engaging member 32 fixed to the cutter carriage 13, a pointer 31 mounted pivotally on the cutter carriage 13 and connected to the resilient engaging member 32, and a scale 33 attached to the cutter carriage 13 adjacent to the pointer 31 and stamped with indicia for incrementally representing the thickness of shaving removed from the workpiece 20 during a pass through the wood passageway. The resilient engaging member 32 is resiliently deflectable, and is adapted to be displaced resiliently by the workpiece 20 to actuate rotation of the pointer 31 when the cutter carriage 13 is moved downwardly to permit the resilient engaging member 32 to contact the workpiece 20.

The wood planing machine 10 is disadvantageous in that it is relatively inconvenient for an operator to view the scale 33 while operating the handle 14 to adjust the height of the cutter carriage 13. Moreover, there is a tendency for the resilient engaging member 32 to experience elastic fatigue after being in use for a period of time, thereby resulting in poor accuracy on the desired thickness of the shaving removed from the workpiece 20.

SUMMARY OF THE INVENTION

Therefore, it is an object of the present invention to provide a wood planing machine that is capable of overcoming the disadvantages described above.

Accordingly, a wood planing machine of this invention comprises: a base having a work table adapted to carry a workpiece, and a plurality of spaced apart posts that extend upright from the work table; a cutter carriage mounted on the posts above the work table, movable along lengths of the posts, and having front and rear sides; a rotary cutter mounted on the cutter carriage and adapted to shave the workpiece; a height adjusting unit for adjusting height of the cutter carriage relative to the work table; and a shaving thickness indicator including a seat mounted on the front side of the cutter carriage and having a bottom opening, a supporting member mounted on a bottom side of the seat and having an aperture aligned vertically with the bottom opening, an actuating member seated on a periphery of the aperture and having a bottom end projecting downwardly through the aperture in a direction toward the work table and a top end projecting upwardly through the bottom opening, and a cam member mounted pivotally on the seat above the bottom opening for rotating about an axis, and having a top end and a bottom lobe abutting against the top end of the actuating member at a contact point that is offset from a vertical line which passes through a center of rotation of the cam member, the actuating member being lifted upwardly by the workpiece to actuate the cam member, via a cam action on the bottom lobe, to rotate about the axis when the bottom end of the actuating member is pushed by the workpiece upon lowering down the cutter carriage, the shaving thickness indicator further including a pointer connected to the top end of the cam member, and an urging member for urging the cam member and the actuating member back to their original positions when the actuating member is released from the workpiece.

BRIEF DESCRIPTION OF THE DRAWINGS

In drawings which illustrate an embodiment of the invention.

DETAILED DESCRIPTION OF THE PREFERRED EMBODIMENT

Figure 1:
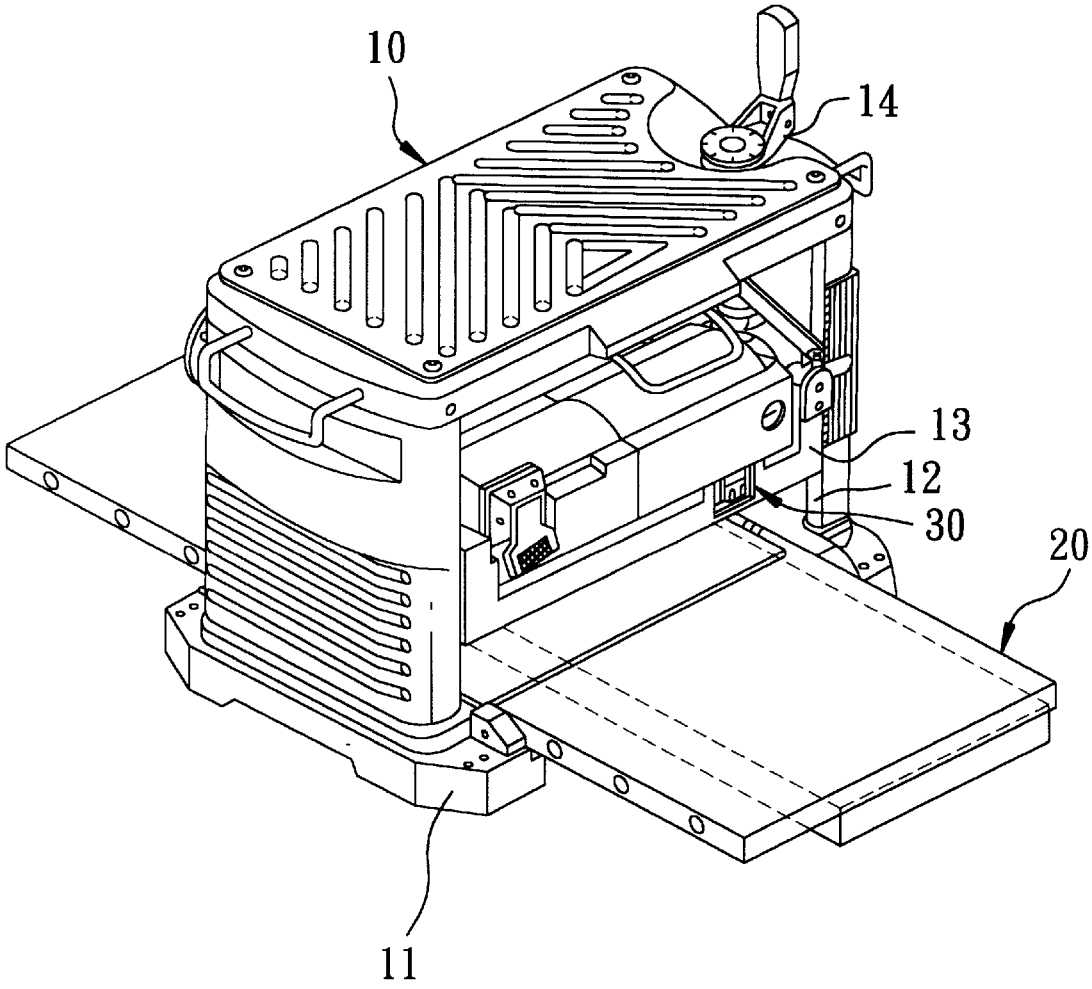
FIG. 1 PRIOR ART
FIG. 1 is a perspective view of a conventional wood planing machine.
Figure 2:
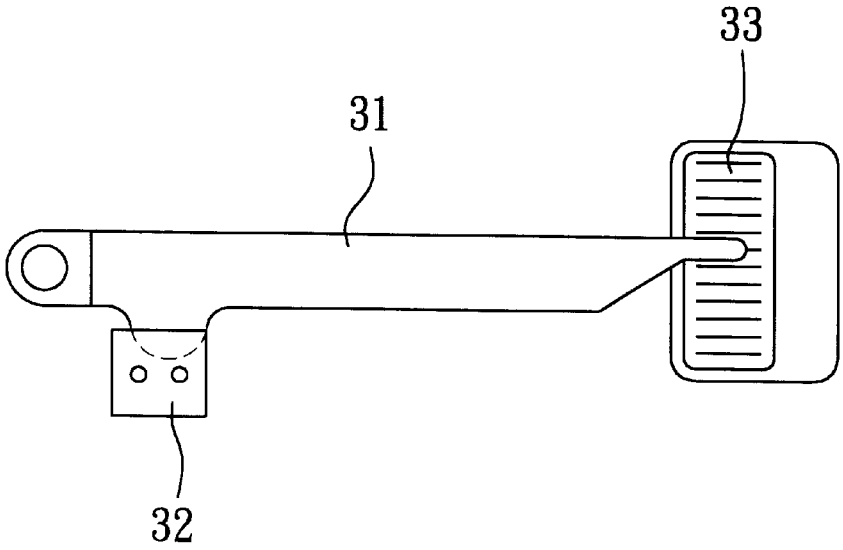
FIG. 2 PRIOR ART
FIG. 2 is a schematic front view of a shaving thickness indicator of the wood planing machine of FIG. 1.
Figure 3:
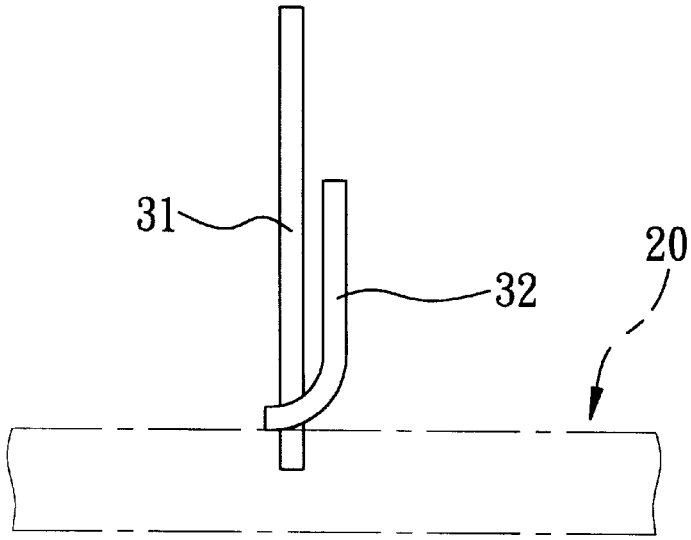
FIG. 3 PRIOR ART
FIG. 3 is a schematic side view to illustrate engagement between the shaving thickness indicator of FIG. 2 and a workpiece.
Figure 4:
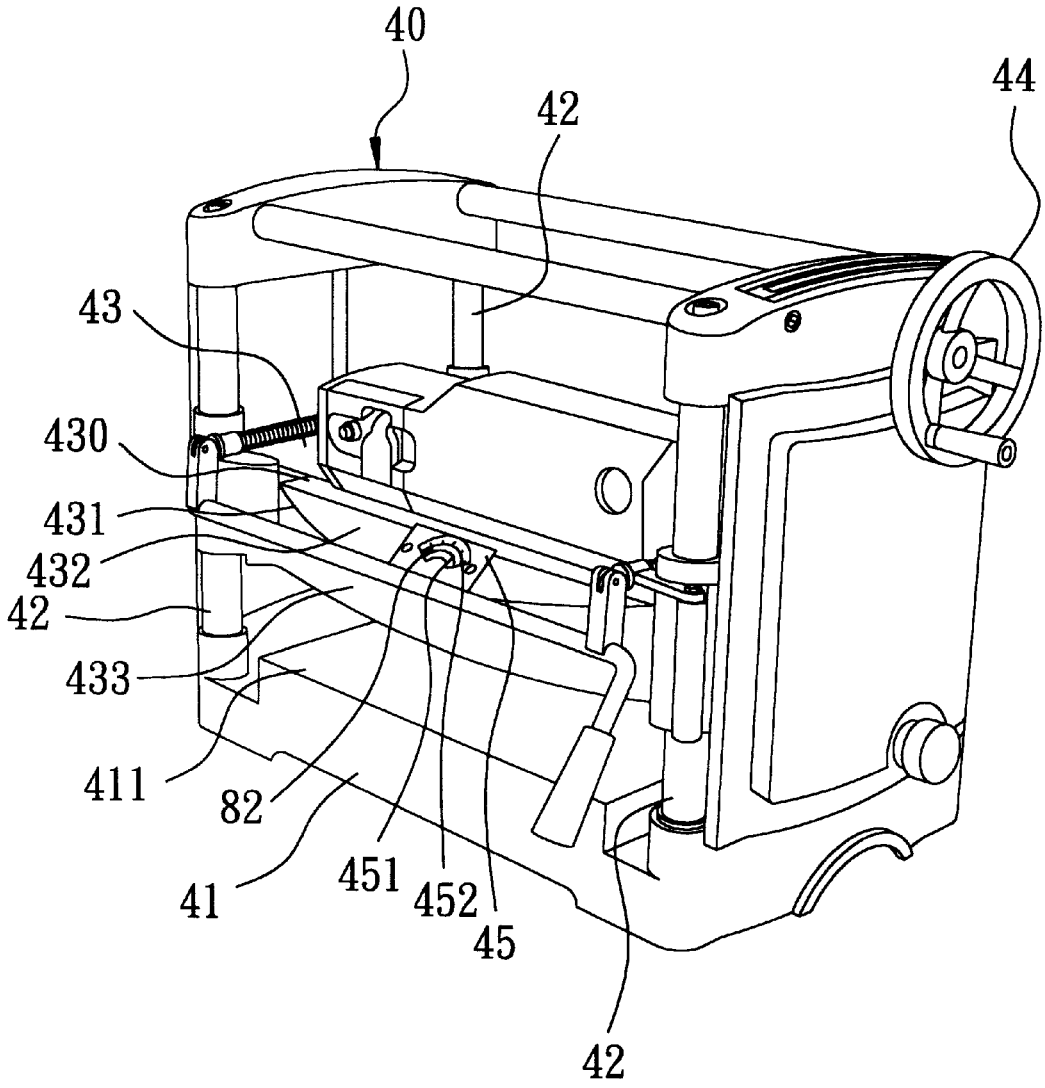
FIG. 4 is a perspective view of a wood planing machine embodying this invention.
Figure 5:
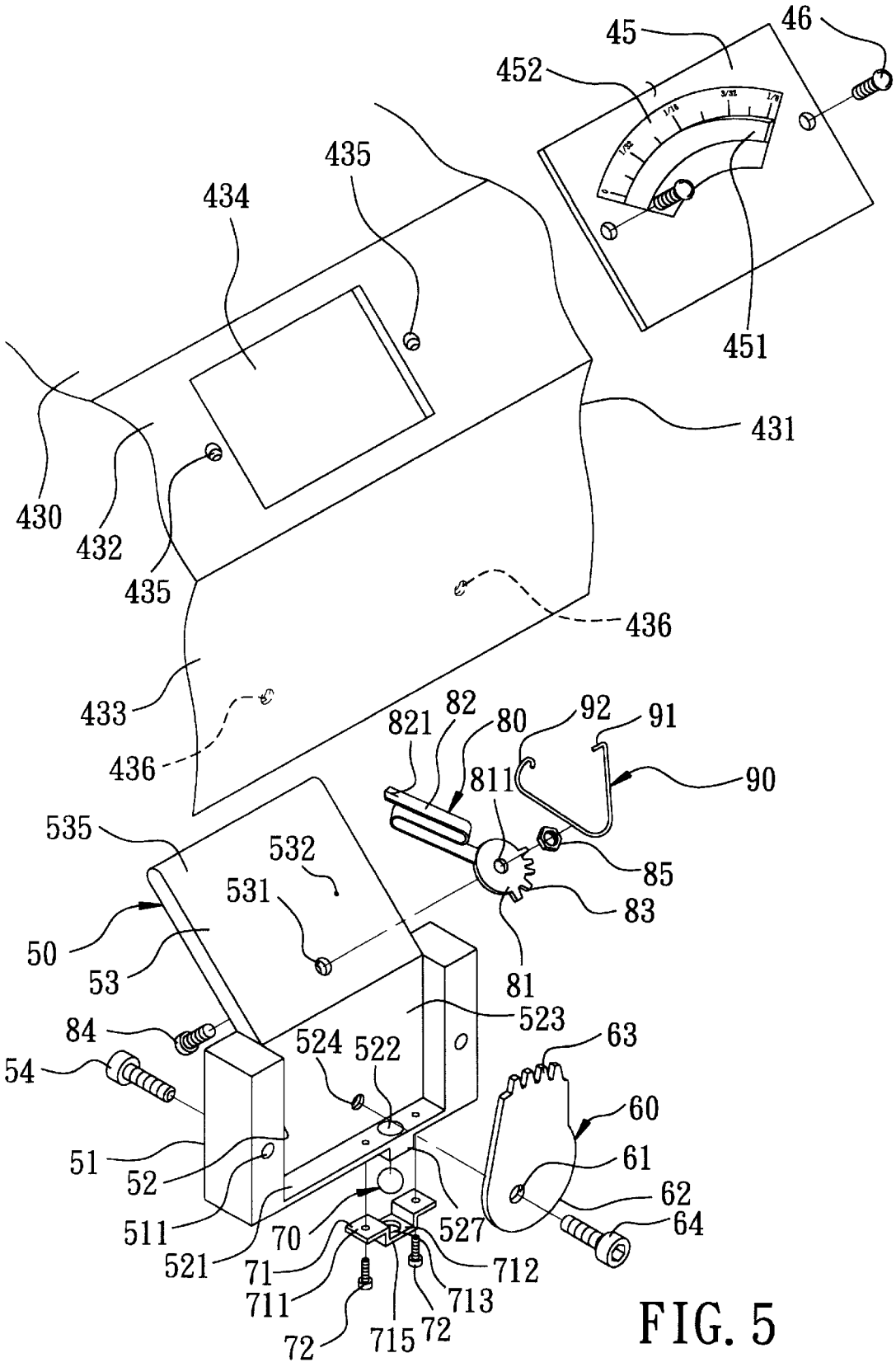
FIG. 5 is an exploded view of a shaving thickness indicator of the wood planing machine of FIG. 4.
Figure 6:
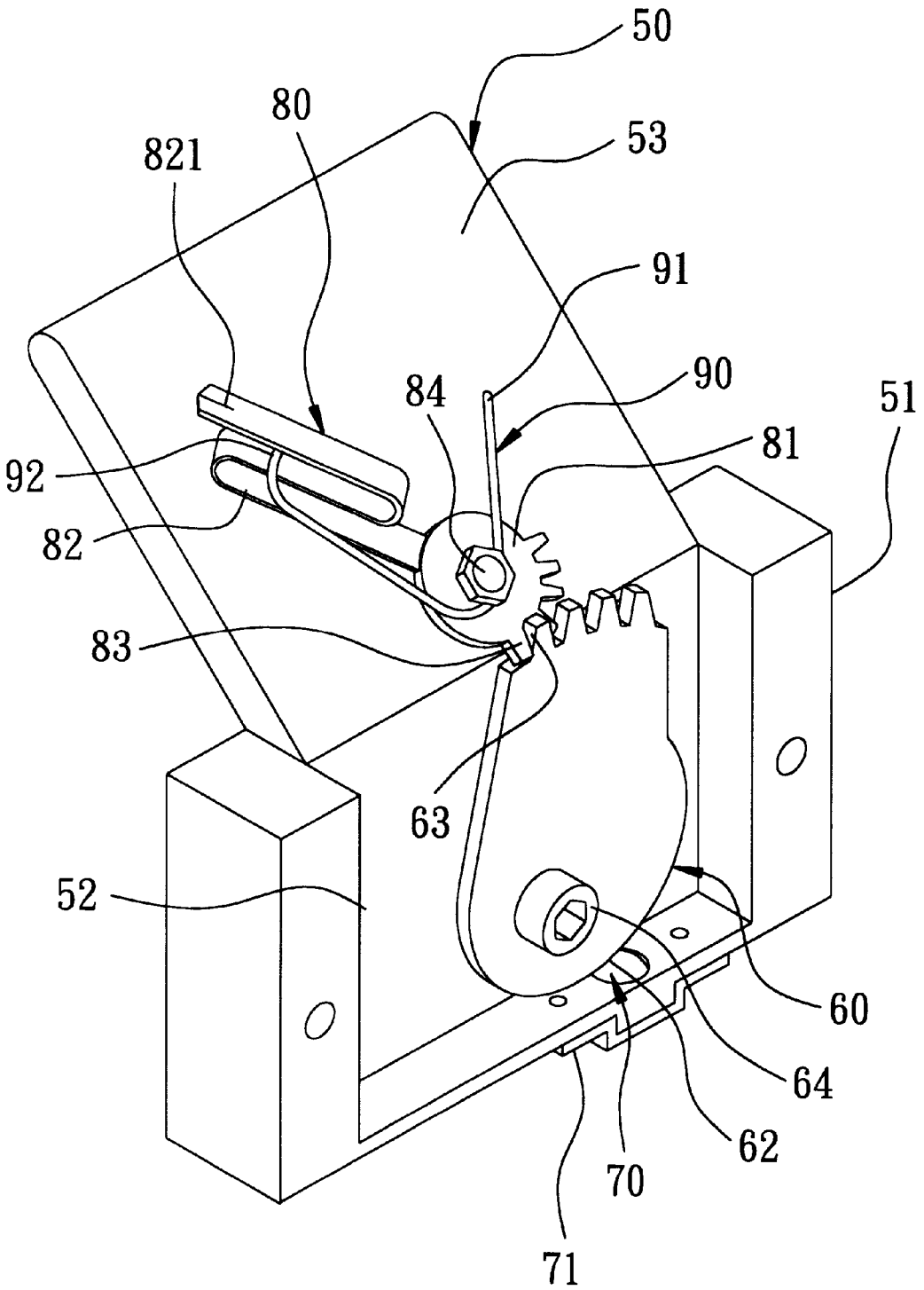
FIG. 6 is a fragmentary perspective view of the shaving thickness indicator of the wood planing machine of FIG. 4.
Figure 7:
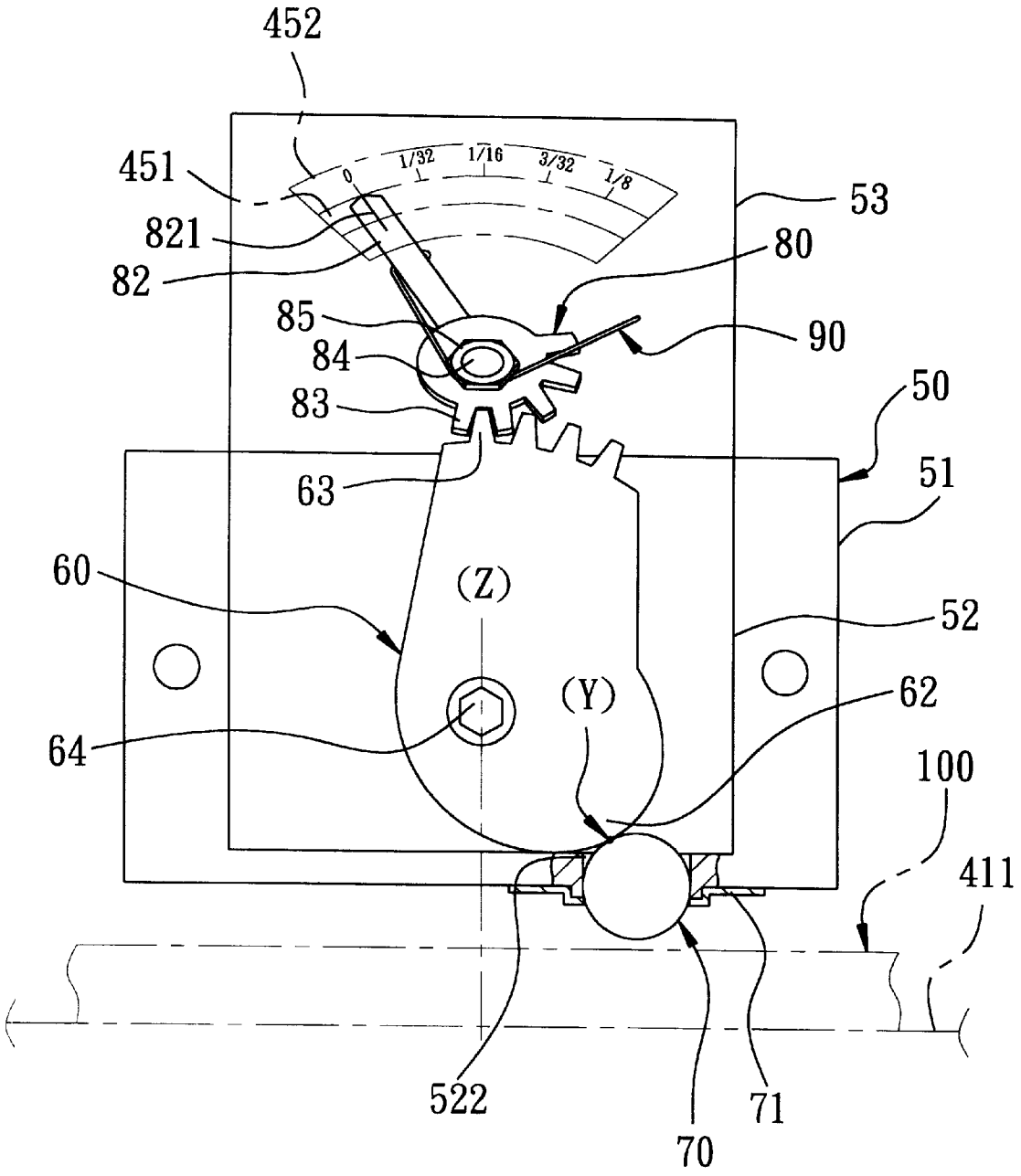
FIG. 7 is a front view of the shaving thickness indicator of the wood planing machine of FIG. 4 in state prior to actuation.

FIGS. 4 to 7 illustrate a wood planing machine 40 embodying this invention. The wood planing machine 40 includes a base having a work table 41 and four posts 42 raising uprightly from four corners of the work table 41, a cutter carriage 43 mounted movably on the posts 41 and having front and rear sides, a motor-driven rotary cutter mounted on the cutter carriage 43, a height adjusting unit (not shown) provided with a handle-wheel 44 for adjusting height of the cutter carriage 43, and a shaving thickness indicator mounted on a front side of the cutter carriage 43. The cutter carriage 43 confines with the work table 41 a wood passageway 411 for passage of a workpiece 100.

A front panel 431 is mounted on the cutter carriage 43, and includes a horizontal plate 430 projecting forwardly and horizontally from the front side of the cutter carriage 43, an oblique plate 432 extending downwardly and inclinedly from the horizontal plate 430, and a vertical plate 433 extending substantially vertically and downwardly from a bottom end of the oblique plate 432. An opening 434 is formed in the oblique plate 432. A scale seat 45 is mounted on a periphery of the opening 434 in the oblique plate 432 via screw means 46 passing through the scale seat 45 and screw holes 435 in the oblique plate 432, and has a scale portion 452 exposed from the opening 434 and stamped with indicia representing the thickness of shaving removed from the workpiece 100 passing through the wood passageway 411 during operation of the wood planing machine 40.

The shaving thickness indicator includes an indicator seat 50, a supporting member 71, an actuating member 70, a cam member 60, a pointer 80, and an urging member 90.

The indicator seat 50 includes a bottom portion 521 having a bottom opening 522 and a hollow stud 527 projecting downwardly from a periphery of the bottom opening 522, opposite side portions 51 projecting upwardly and vertically from two opposite sides of the bottom portion 521 and secured to a rear side of the vertical plate 433 via screw means 54 passing through screw holes 511 in the side portions 51 and screw holes 436 in the vertical plate 433, a vertical portion 523 projecting vertically and upwardly from the bottom portion 521 at one side of the bottom opening 522, interconnecting the side portions 51, and having a top end substantially flush with the top end of the vertical plate 433, and an oblique portion 53 projecting upwardly and inclinedly from the top end of the vertical portion 523 in a direction toward the rear side of the cutter carriage 43 to a top end of the oblique plate 432, and having a front face 535 aligned with and exposed from the opening 434 in the front plate 432, and a positioning hole 532 formed therein. The vertical portion 523 cooperates with the side portions 51, the bottom portion 521, and a portion of the front plate 433 to confine a recess 52 thereamong. Preferably, the oblique portion 53 is inclined to the vertical portion 523 at an angle of about 45° for a better view of the pointer 80 which is mounted thereon and which is to be described in greater detail herein below.

The supporting member 71 has opposite side lugs 711 secured to the bottom portion 521 of the indicator seat 50 via screw means 72 passing through the side lugs 711 and the bottom portion 521 of the indicator seat 50, and a U-shaped plate 715 interconnecting and projecting downwardly from the side lugs 711 and defining a recess 712 that receives fittingly the stud 527. An aperture 713 is formed in the U-shaped plate 715, and is vertically aligned with the bottom opening 522 in the bottom portion 521 of the indicator seat 50.

The actuating member 70, which is preferably a rigid ball body in this embodiment, is seated on a periphery of the aperture 713, is received in the hollow stud 527, and has a bottom end projecting downwardly through the aperture 713 in a direction toward the work table 41, and a top end projecting upwardly through the hollow stud 527 and the bottom opening 522 and into the recess 52 in the indicator seat 50.

The cam member 60 is a plate, which is mounted pivotally on the vertical portion 523 of the indicator seat 50 within the recess 52 via a pivot bolt 64 passing through a screw hole 61 in the cam member 60 and a screw hole 524 in the vertical portion 523 of the indicator seat 50 for rotating about an axis defined by the pivot bolt 64, and has a top end formed with a gear toothed top edge 63 projecting upwardly beyond the top end of the vertical portion 523, and a bottom lobe 62 opposite to the gear toothed top edge 63 and abutting against the top end of the actuating member 70 at a contact point (Y) that is offset from a vertical line (Z) which passes through the center of rotation of the cam member 60.

The pointer 80 has a bottom pivot end 81, which is a round plate mounted pivotally on the front face 535 of the oblique portion 53 of the indicator seat 50 via a pivot screw 84 passing through a screw hole 531 in the oblique portion 53 and a hole 811 in the bottom pivot end 81 for rotating about an axis defined by the pivot screw 84, and a substantially S-shaped narrow plate portion 82 projecting upwardly from the bottom pivot end 81 to a position aligned with the scale portion 452 of the scale seat 45. The bottom pivot end 81 is formed with a gear toothed bottom edge 83 that meshes with the gear toothed top edge 63 of the cam member 60 so that the pointer 80 is actuated to turn about the pivot screw 84 when the cam member 60 turns about the pivot bolt 64 upon actuation by the actuating member 70 (see FIG. 8). A reference line 821 is marked on a tip of the S-shaped narrow plate portion 82 to correspond to the indicia on the scale portion 452.

The scale seat 45 further includes a window 451 formed below the scale portion 452 to enable the user to view the position of the reference line 821 of the S-shaped narrow plate portion 82 of the pointer 80 when operating the wood planing machine 40.

Figure 8:
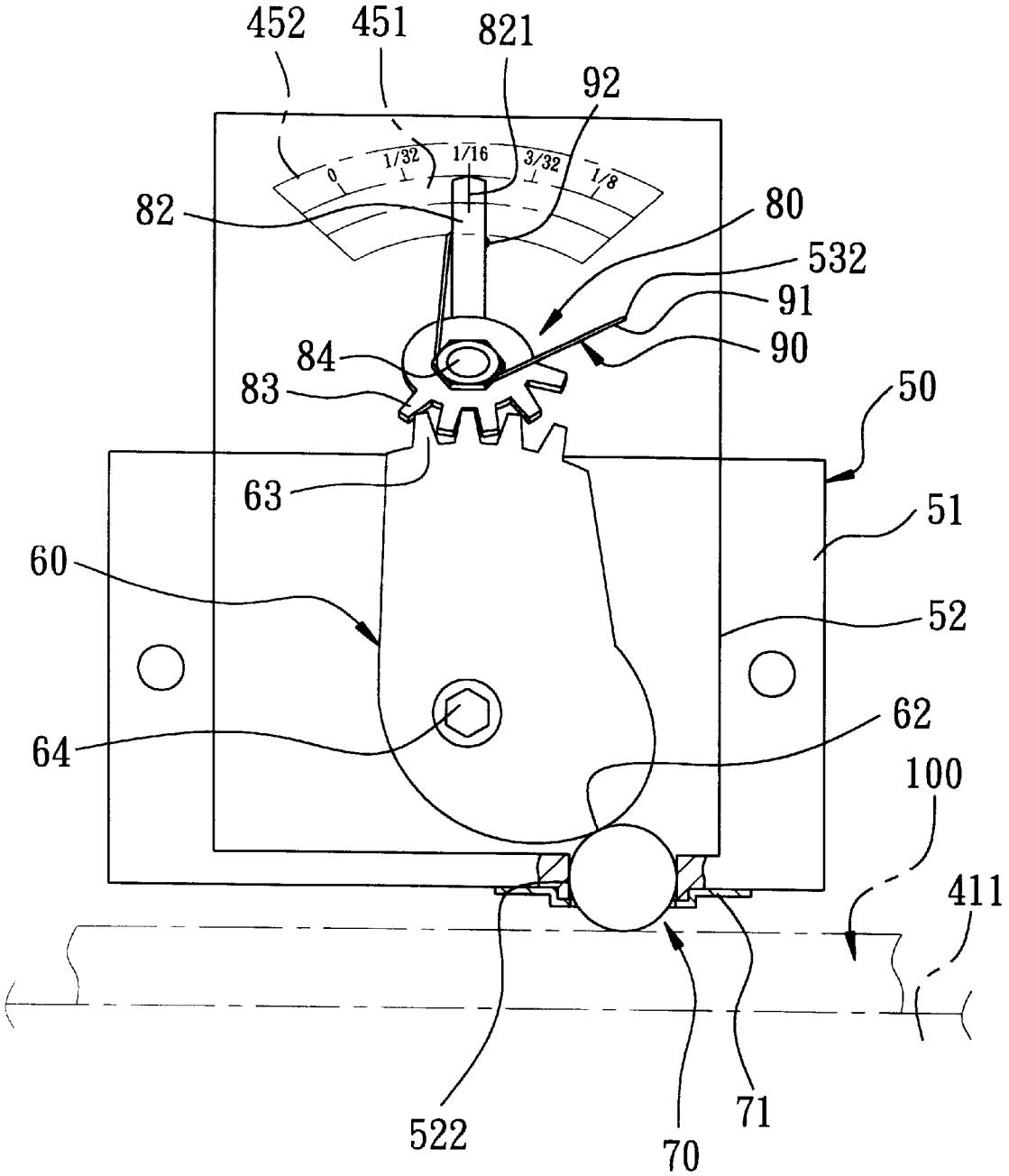
FIG. 8 is a front view of the shaving thickness indicator of the wood planing machine of FIG. 4 in a state after actuation.

During operation, the actuating member 70 is lifted upwardly by the workpiece 100 to actuate the cam member 60, via a cam action on the bottom lobe 62, to rotate about the pivot bolt 64, thereby driving the pointer 80 to turn about the pivot screw 84 (see FIG. 8). The urging member 90 is preferably a torsion spring mounted securely on the bottom pivot end 81 of the pointer 80 via the pivot screw 84 and a nut 85 which engages threadedly the pivot screw 84, and having two opposite hook ends 91, 92 respectively engaging the positioning hole 532 in the oblique portion 53 and the S-shaped narrow plate portion 82 of the pointer 80 for urging the cam member 60 and the actuating member 70 back to their original positions when the actuating member 70 is released from the workpiece 100.

With the shaving thickness indicator of this invention, the inconvenience and the poor accuracy drawbacks encountered in the prior art can be eliminated.

With the invention thus explained, it is apparent that various modifications and variations can be made without departing from the spirit of the present invention. It is therefore intended that the invention be limited only as recited in the appended claims.

I claim:

1. A wood planing machine comprising:

a base having a work table adapted to carry a workpiece, and a plurality of spaced apart posts that extend upright from said work table;

a cutter carriage mounted on said posts above said work table, movable along lengths of said posts, and having front and rear sides;

a rotary cutter mounted on said cutter carriage and adapted to shave the workpiece;

a height adjusting unit for adjusting height of said cutter carriage relative to said work table; and a shaving thickness indicator including a seat mounted on said front side of said cutter carriage and having a bottom opening, a supporting member mounted on a bottom side of said seat and having an aperture aligned vertically with said bottom opening, an actuating member seated on a periphery of said aperture and having a bottom end projecting downwardly through said aperture in a direction toward said work table and a top end projecting upwardly through said bottom opening, and a cam member mounted pivotally on said seat above said bottom opening for rotating about an axis, and having a top end and a bottom lobe abutting against said top end of said actuating member at a contact point that is offset from a vertical line which passes through a center of rotation of said cam member, said actuating member being lifted upwardly by the workpiece to actuate said cam member, via a cam action on said bottom lobe, to rotate about said axis when said bottom end of said actuating member is pushed by the workpiece upon lowering down said cutter carriage, said shaving thickness indicator further including a pointer connected to said top end of said cam member, and an urging member for urging said cam member and said actuating member back to their original positions when said actuating member is released from the workpiece.

2. The wood planing machine of claim 1, wherein said actuating member is a rigid ball body.

3. The wood planing machine of claim 2, wherein said pointer includes a bottom pivot end mounted pivotally on said seat above said cam member and having a gear toothed bottom edge, said top end of said cam member having a gear toothed top edge that meshes with said gear toothed bottom edge.

4. The wood planing machine of claim 3, wherein said urging member is a torsion spring mounted securely on said bottom pivot end of said pointer.

5. The wood planing machine of claim 4, wherein said seat has a bottom portion formed with said bottom opening, a vertical portion projecting vertically and upwardly from said bottom portion at one side of said bottom opening, and an oblique portion projecting upwardly and inclinedly from a top end of said vertical portion in a direction toward said rear side of said cutter carriage, said cam member being a plate mounted pivotally on said vertical portion, said bottom pivot end of said pointer being a round plate mounted pivotally on said oblique portion.

6. The wood planing machine of claim 5, wherein said cutter carriage includes a front panel projecting from said front side thereof, and having a vertical plate and an oblique plate projecting upwardly and inclinedly from a top end of said vertical plate and having an opening formed therein, said seat further including two opposite side portions projecting upwardly from two opposite sides of said bottom portion and secured to said vertical plate, said top end of said vertical portion of said seat being substantially flush with said top end of said vertical plate, said oblique portion of said seat projecting to a position aligned with said opening in said oblique plate for exposing said pointer from said opening.

7. The wood planing machine of claim 6, wherein said oblique portion is inclined to said vertical portion at an angle of about 45°.

8. The wood planing machine of claim 7, wherein said shaving thickness indicator further includes a scale seat mounted on a periphery of said opening in said oblique plate, and having a scale portion that is stamped with indicia, and a window for exposing said pointer.

* * * * *